US006729294B2

(12) United States Patent
Okano et al.

(10) Patent No.: US 6,729,294 B2
(45) Date of Patent: May 4, 2004

(54) V-TYPE ENGINE FOR MOTORCYCLE

(75) Inventors: Shigetaro Okano, Saitama (JP); Tsuguto Inayama, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 55 days.

(21) Appl. No.: 10/214,778

(22) Filed: Aug. 9, 2002

(65) Prior Publication Data

US 2003/0062018 A1 Apr. 3, 2003

(30) Foreign Application Priority Data

Sep. 10, 2001 (JP) ..... 2001-273597

(51) Int. Cl.[7] ..... F02B 77/00

(52) U.S. Cl. ..... 123/198 E; 123/195 C

(58) Field of Search ..... 123/198 E, 195 C

(56) References Cited

FOREIGN PATENT DOCUMENTS

JP 60-53625 A 3/1985

*Primary Examiner*—Noah P. Kamen
(74) *Attorney, Agent, or Firm*—Birch, Stewart, Kolasch & Birch, LLP

(57) ABSTRACT

In a V-type engine for a motorcycle in which both banks are arranged in a V-shape in a plane orthogonal to the axis of a crankshaft and the heights of both the banks are different from each other, the heights of the pair of banks are visually recognized to be almost equal to enhance the functional beauty of the engine and improve the marketability. A plurality of fins are aligned in the direction along cylinder axes and are provided on sides of cylinders and on sides of dummy covers for covering at least part of cylinder heads from the sides. Wherein the total number and center line mutual distances of the fins are almost equal in both banks. Lengths between the center lines of the fins closest to a crankshaft of the fins and a cross point of the cylinder axes are set to be almost equal in both the banks.

20 Claims, 11 Drawing Sheets

V-TYPE ENGINE FOR MOTORCYCLE

BACKGROUND OF THE INVENTION

CROSS-REFERENCE TO RELATED APPLICATIONS

The present application claims priority under 35 USC 119 to Japanese Patent Application No. 2001-273597 filed on Sep. 10, 2001 the entire contents thereof is hereby incorporated by reference.

1. Field of the Invention

The present invention relates to a V-type engine for a motorcycle in which a first bank having a first cylinder coupled to a first cylinder head and a second bank having a second cylinder coupled to a second cylinder head are arranged in a V-shape in a plane orthogonal to the axis of a crankshaft. A length between a cross point at which cylinder axes of the first and second cylinders cross each other in the plane and a deck surface of the first cylinder head and a length between said cross point and a deck surface of the second cylinder head are set to be different relative to each other.

2. Description of Background Art

A V-type engine for a motorcycle is disclosed in Japanese Published Unexamined Patent Application No. Sho 60-53625. To set a nip angle of a pair of banks to a minimum, a cross point of cylinder axes of a pair of banks is arranged in a position offset from the axis of a crankshaft and the lengths between the cross point and deck surfaces of the cylinders of both the banks are set to be different relative to each other. In this disclosure, the lengths between the cross point and the deck surfaces of the cylinder heads of both the banks are considered to be essentially different relative to each other.

In a motorcycle, particularly, a custom-type motorcycle, the functional beauty (functional appearance) of the mounting of an engine occupies an important position. As described above, the lengths between the deck surfaces of the cylinder heads of a pair of banks and a cross point of cylinder axes of both the banks are different for both of the banks. A difference in height between both the banks is significantly visual. A feeling of unbalance may be produced to deteriorate the functional beauty. In particular, in a V-type engine having a nip angle below 90° which is mounted on a custom-type motorcycle in many cases, the height of both the banks is easily compared visually so that the unbalance feeling is easily emphasized.

SUMMARY AND OBJECTS OF THE INVENTION

The present invention has been made in view of such circumstances and it is an object of the present invention is to provide a V-type engine for a motorcycle which enhances the functional beauty of the engine and improves the marketability so that the height of a pair of banks is visually recognized to be almost equal.

To achieve the foregoing object, in the present invention, a V-type engine for a motorcycle including a first bank having a first cylinder coupled to a first cylinder head and a second bank having a second cylinder coupled to a second cylinder head are arranged in a V-shape in a plane orthogonal to the axis of a crankshaft. A length between a cross point at which cylinder axes of the first and second cylinders cross each other in the plane and a deck surface of the first cylinder head and a length between the cross point and a deck surface of the second cylinder head are set to be different from each other. In the sides of the first and second cylinders or the sides of dummy covers for covering at least part of the first and second cylinders from the sides and in the sides of the first and second cylinder heads or the sides of the dummy covers for covering at least part of the first and second cylinder heads from the sides, a plurality of fins are aligned in the direction along the cylinder axes of the first and second cylinders that are provided so that the total numbers of the fins and center line mutual distances of the fins are almost equal in the first and second banks. The lengths in the plane between the center lines of the fins closest to the crankshaft of the fins and the cross point are set to be almost equal in the first and second banks.

In such a construction according to the present invention, the heights of a pair of the banks are visually recognized to be almost equal to enhance the functional beauty of the engine. A plurality of fins are provided on the sides of the cylinders and the cylinder heads for the purpose of cooling or a plurality of fins are provided in the sides of the dummy covers for covering at least part of the cylinders and the cylinder heads from the sides for enhancing the appearance and having a function to decide the appearance shape of both the banks. The total numbers of a plurality of the fins aligned in the direction along the cylinder axes of the first and second cylinders and the center line mutual distances of the fins are almost equal in the first and second banks. The lengths of the center lines of the fins closest to the crankshaft of the fins and the cross point of both the cylinder axes are set to be almost equal in the first and second banks. The fins of both the banks are arranged to correspond to almost the same position along the cylinder axes of the banks. Thus, a visual impression without any difference in height between the pair of banks can be obtained. The present invention provides for a functional beauty of the V-type engine to be enhanced. The marketability of the V-type engine is thus improved.

In the present invention, the contour shapes including the fins of the first and second cylinders or the dummy covers for covering at least part of the first and second cylinders from the sides and the first and second cylinder heads or the dummy covers for covering at least part of the first and second cylinder heads from the sides are formed almost symmetrically with respect to a plane including a bisector between both the banks passing though the cross point in the side view in the direction along the axis of the crankshaft. According to such a construction, the contour shapes of the first and second banks are shaped almost symmetrically. The functional beauty of the V-type engine can be enhanced. The marketability can be improved.

In the present invention the lengths between cross points at which first and second head covers are coupled to the first and second cylinder heads or first and second overhead covers are provided for covering at least part of the first and second head covers from above and the sides cross the cylinder axes of the first and second cylinders in the plane and the cross point at which the cylinder axes of the first and second cylinders cross each other in the plane are set to be almost equal in the first and second banks. According to such a construction, the height difference and the appearance shape difference between both the banks appear to be smaller. The functional beauty of the V-type engine can be enhanced. Thus, the marketability can be improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention shown in the accompanying drawings will be described hereinbelow.

FIGS. 1 to 17 show an embodiment of the present invention. In the following description, "left," "right," "front," "rear," "up" and "down" are referred to with reference to the body of a motorcycle.

Figure 1:
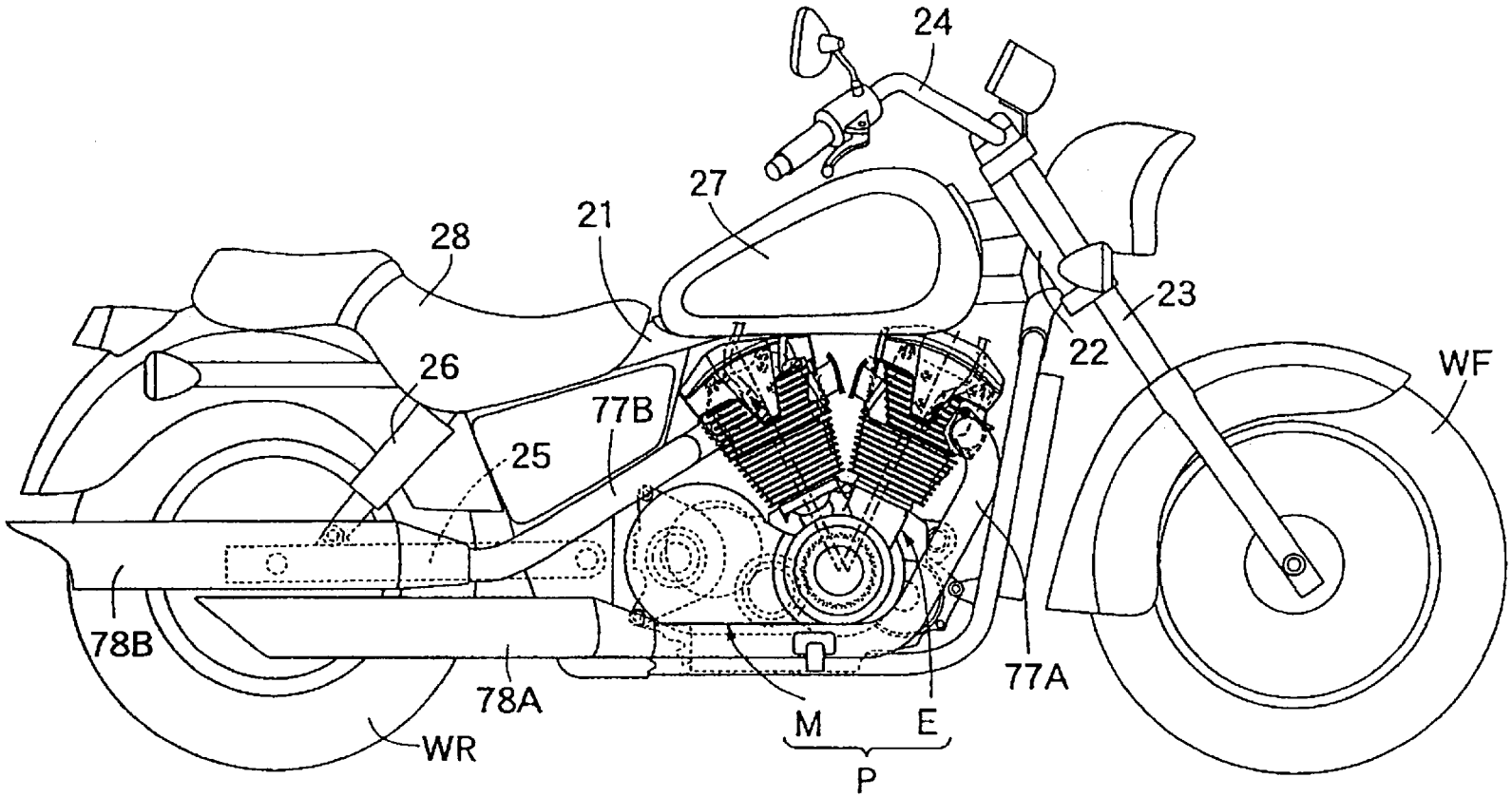
FIG. 1 is a right side view of a motorcycle.

In FIG. 1, in a head pipe 22 provided at the front end of a body frame 21 of a custom-type motorcycle, a front fork 23 for supporting a front wheel WF is supported steerably. The upper end of the front fork 23 is coupled to a steering wheel 24. The rear portion of the body frame 21 is coupled to a rear fork 25 for supporting a rear wheel WR so as to be swingable upwardly or downwardly. A rear cushion 26 is interposed between the rear fork 25 and the body frame 21.

A fuel tank 27 is mounted on the body frame 21 rearwardly of the head pipe 22. A tandem-type riding seat 28 is provided on the body frame 21 rearwardly of the fuel tank 27.

A power unit P mounted on the body frame 21 is arranged below the fuel tank 27. The power unit P has a two-cylinder engine E and a transmission M for shifting the rotating power of the engine E which is then transmitted to the rear wheel WR.

Figure 2:
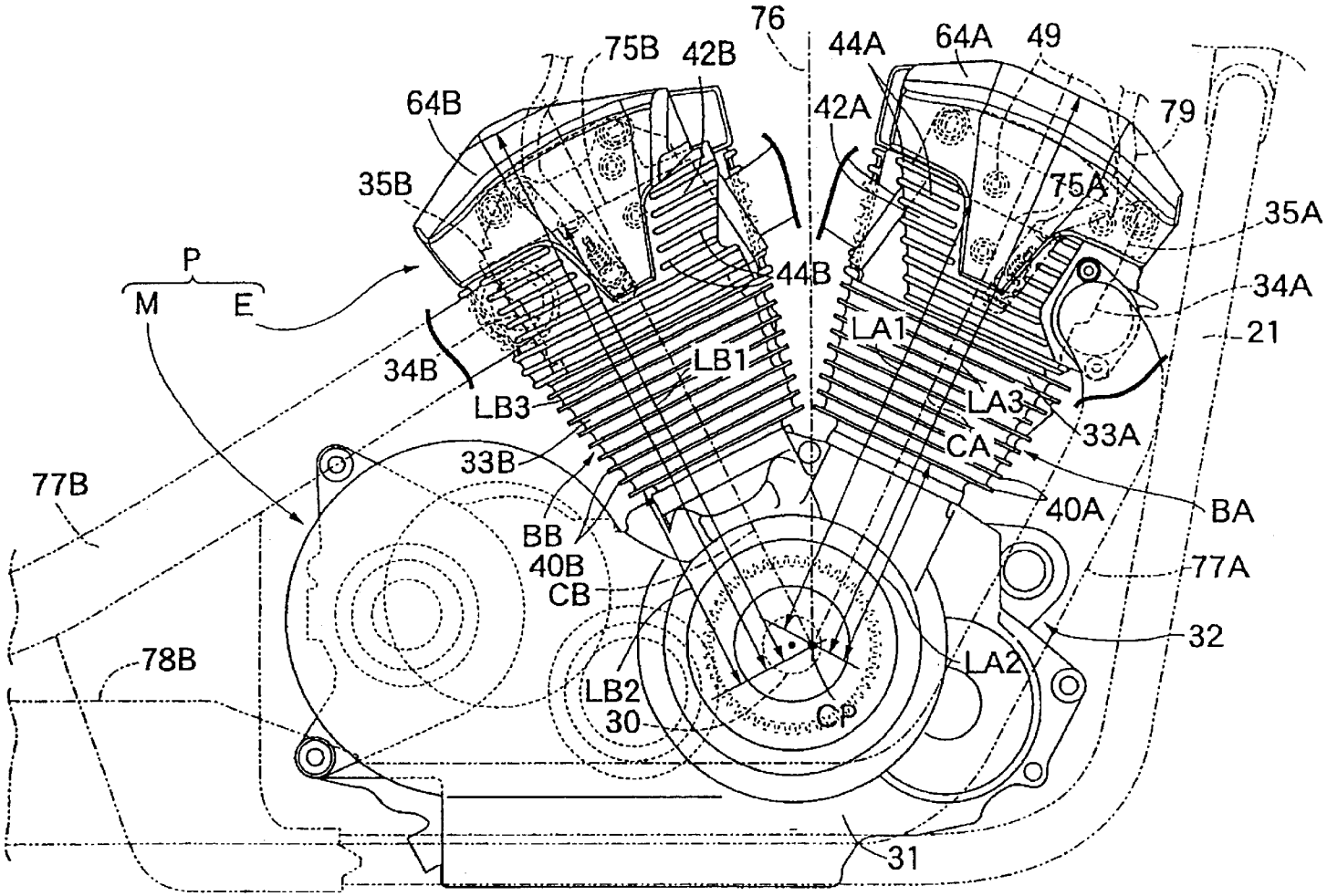
FIG. 2 is a side view of a power unit viewed from the right side of the motorcycle.
Figure 3:
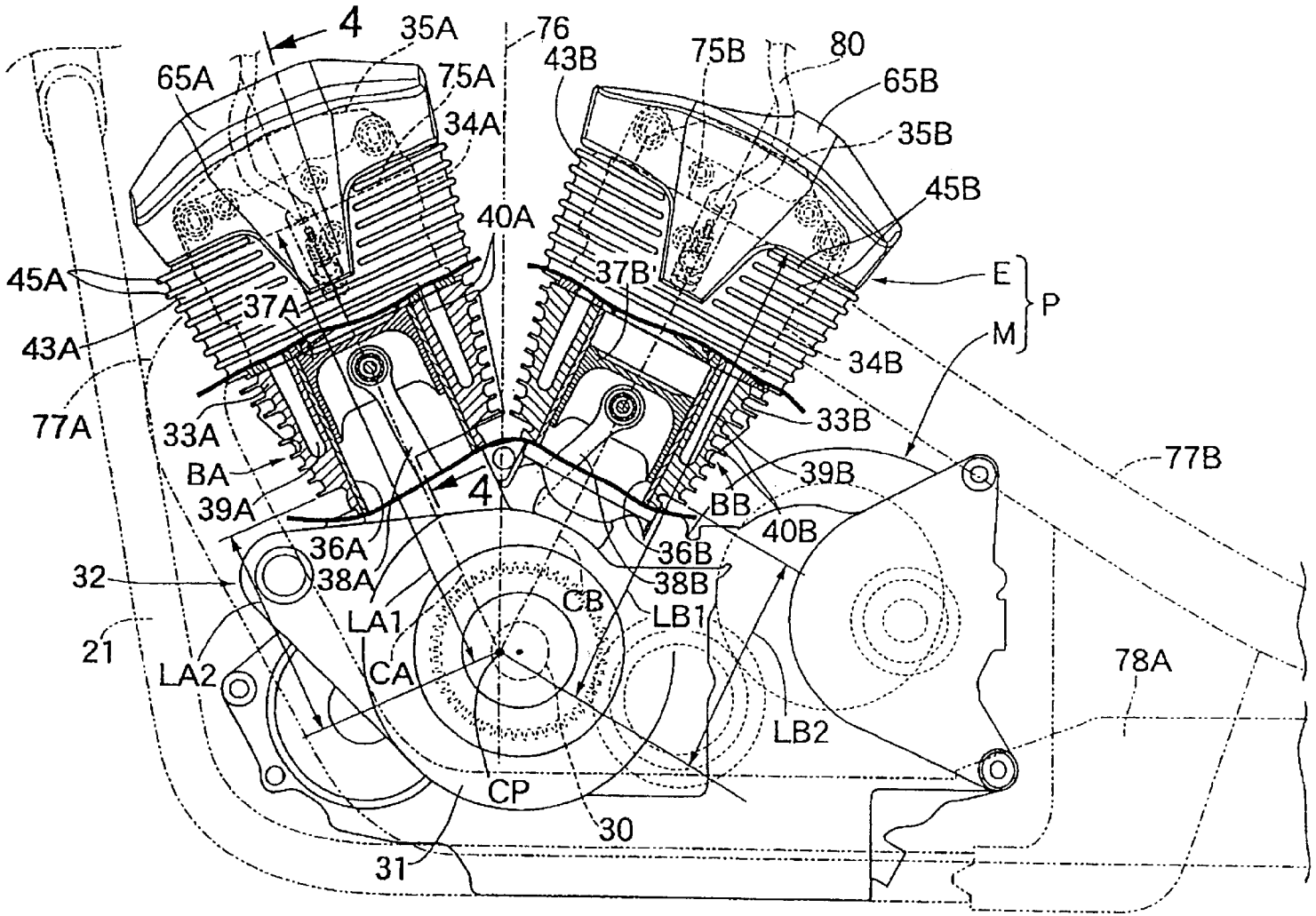
FIG. 3 is a partially cutaway longitudinal side view of the power unit viewed from the left side of the motorcycle.

Referring to FIGS. 2 and 3, the engine E is a V-type engine in which a first bank BA and a second bank BB, which is arranged rearwardly of the first bank BA, are arranged in a V-shape in a plane orthogonal to the axis of a crankshaft 30 having an axis extending horizontally in the right and left directions of the body frame 21. The crankshaft 30 is rotatably supported in a crankcase 31 serving as a transmission case of the transmission M.

An engine main unit 32 of the engine E includes the crankcase 31, a first cylinder 33A coupled to the crankcase 31 with a second cylinder 33B coupled to the crankcase 31 rearwardly of the first cylinder 33A. A first cylinder head 34A is coupled to the first cylinder 33A with a second cylinder head 34B coupled to the second cylinder 33B. A first head cover 35A is coupled to the first cylinder head 34A, and a second head cover 35B is coupled to the second cylinder head 34B.

The first bank BA has the first cylinder 33A and the first cylinder head 34A coupled to each other. The second bank BB has the first cylinder 33B and the second cylinder head 34B coupled to each other and is arranged rearwardly of the first bank BA.

Pistons 37A, 37B are slidably disposed in the cylinder bores 36A, 36B provided in the first and second cylinders 33A, 33B and are coupled to the crankshaft 30 via connecting rods 38A, 38B.

The engine E is a water-cooled engine. A first cooling water jacket 31A is formed in the first cylinder 33A and the first cylinder head 34A of the first bank BA. A second cooling water jacket 31B is formed in the second cylinder 33B and the second cylinder head 34B of the second bank BB. Originally, cooling fins required in an air-cooled engine are not needed to be provided adjacent to the sides of the first and second cylinders 33A, 33B. To enhance the functional beauty (functional appearance) of the engine E, the first cylinder 33A is provided with a plurality of fins 40A . . . along its sides aligned in the direction along a cylinder axis CA of the first cylinder 33A. The second cylinder 33B is provided with a plurality of fins 40B . . . along its sides in a number equal to the fins 40A . . . of the first cylinder 33A aligned in the direction along a cylinder axis CB of the second cylinder 33B.

Figure 4:
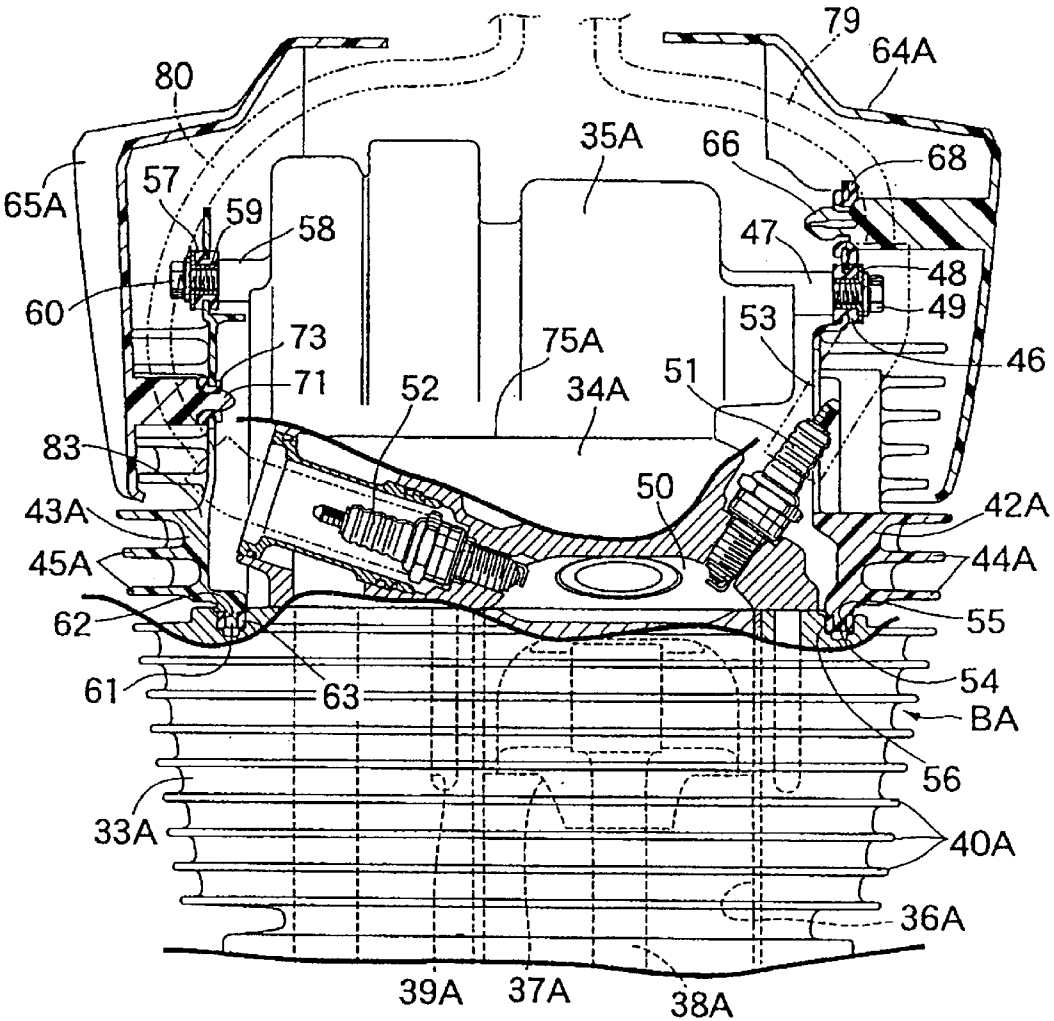
FIG. 4 is an enlarged cross-sectional view taken along line 4—4 of FIG. 3.

Referring to FIG. 4, the right sides of the first cylinder head 34A and the first head cover 35A are covered by a right-side first dummy cover 42A. The left sides of the first cylinder head 34A and the first head cover 35A are covered by a left-side first dummy cover 43A. These dummy covers 42A, 43A are intended for enhancing the functional beauty of the engine E and are made of metal to eliminate heat and to enhance the functional beauty. An equal plurality of fins 44A . . . , 45A . . . as dummy cooling fins are provided in the sides of the dummy covers 42A, 43A, respectively.

Figure 5:
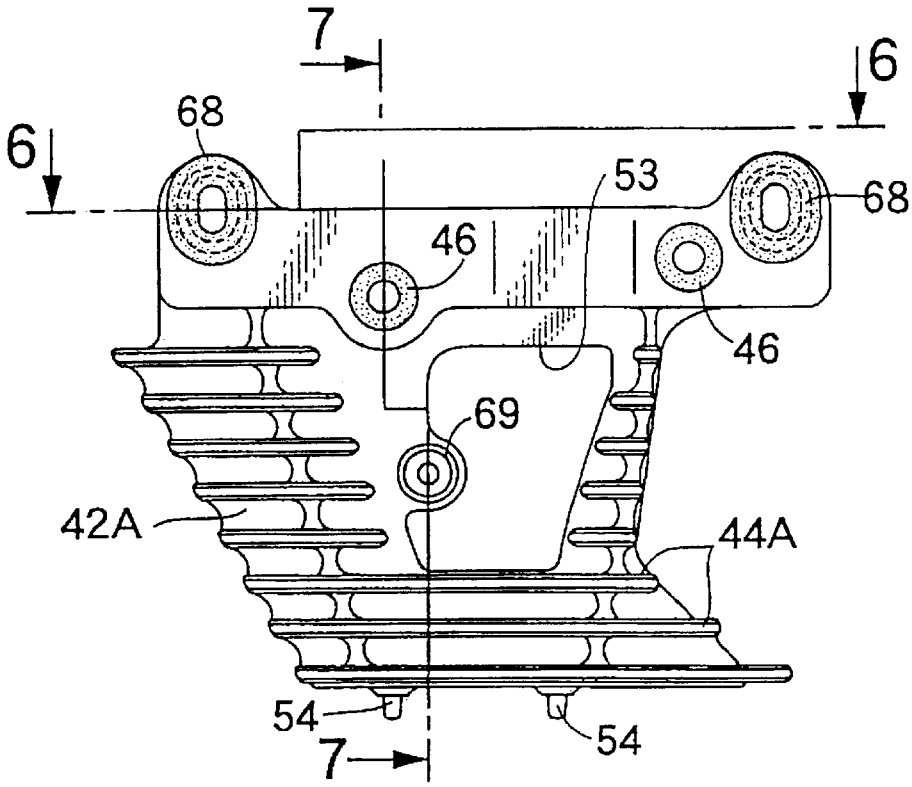
FIG. 5 is a left side view of a right-side dummy cover.
Figure 6:
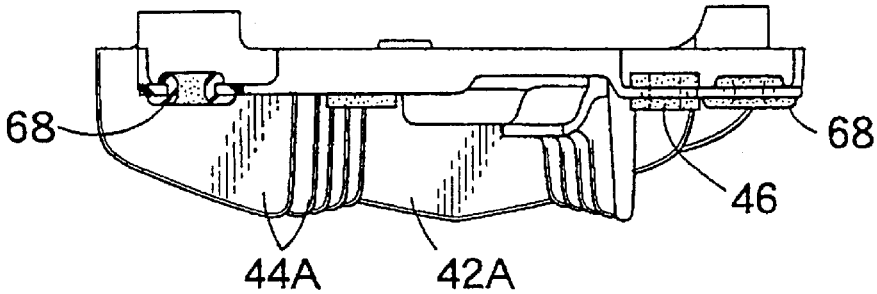
FIG. 6 is a cross-sectional view taken along line 6—6 of FIG. 5.
Figure 7:
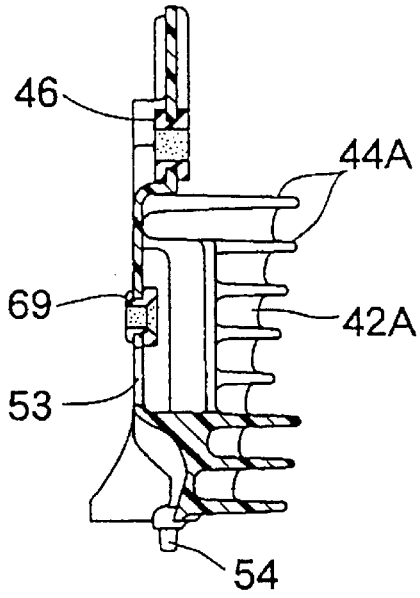
FIG. 7 is a cross-sectional view taken along line 7—7 of FIG. 5.

In FIGS. 5 to 7, in the upper portion of the right-side first dummy cover 42A, at least one cylindrical resilient member 46 (a pair of cylindrical resilient members 46, 46 in this embodiment) is provided. In the right side of the first head cover 35A as part of the engine main unit 32, bosses 47 . . . corresponding to the resilient members 46, 46 protrudes outwardly. Bolts 41 . . . extending through metal sleeves 48 . . . inserted into the resilient members 46, 46 are threadedly engaged with the bosses 47 . . . . At least one spot (two spots in this embodiment) of the right-side first dummy cover 42A is fastened to the first head cover 35A as part of the engine main unit 32 with the bolts 41 . . . .

On the first cylinder head 34A, a pair of spark plugs 51, 52 facing a combustion chamber 50 are mounted. A notch 53 for arranging the one spark plug 51 is provided in the right-side first dummy cover 42A. The fins 44A . . . avoid the notch 53 and are provided on the side of the right-side first dummy cover 42A.

At least one projection 54 (a pair of projections 54, 54 in this embodiment) protrude in the lower portion of the right-side first dummy cover 42A. In the first cylinder 33A in a portion corresponding to the fin 40A closest to the first cylinder head 34A of the fins 40A . . . in the first cylinder 33A, that is, the uppermost fin 40A, metal cylindrical members 56 . . . are buried corresponding to the projections 54 . . . . The projections 54 . . . are fitted in recesses 55 . . . provided in the first cylinder 33A so as to be constructed by the cylindrical members 56 . . . and the first cylinder 33A.

Figure 8:
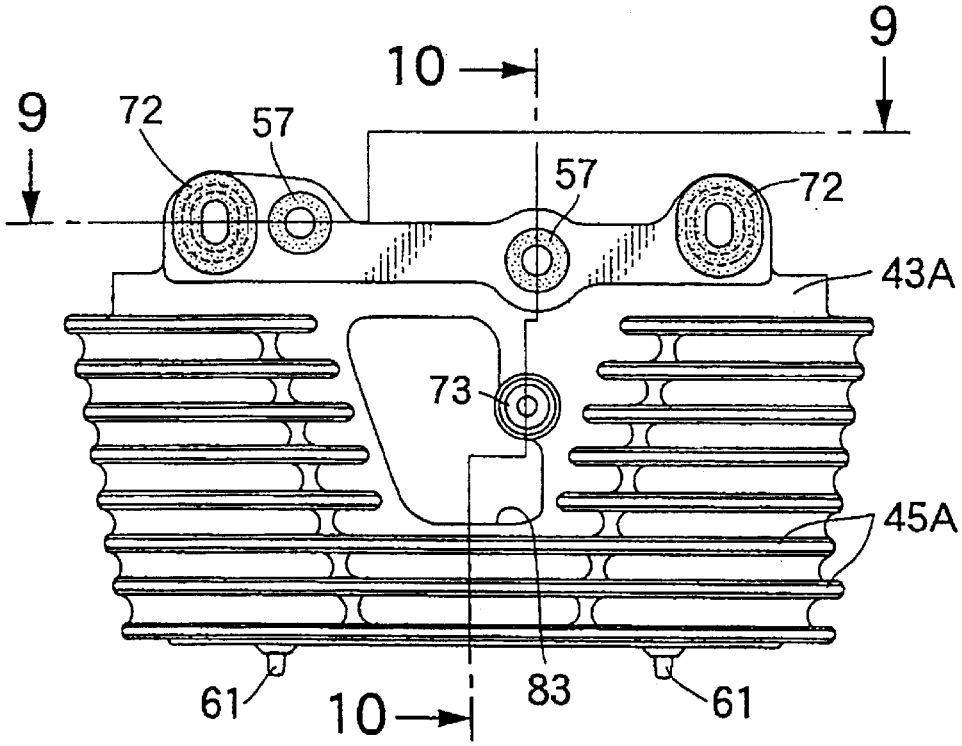
FIG. 8 is a right side view of a left-side dummy cover.
Figure 9:
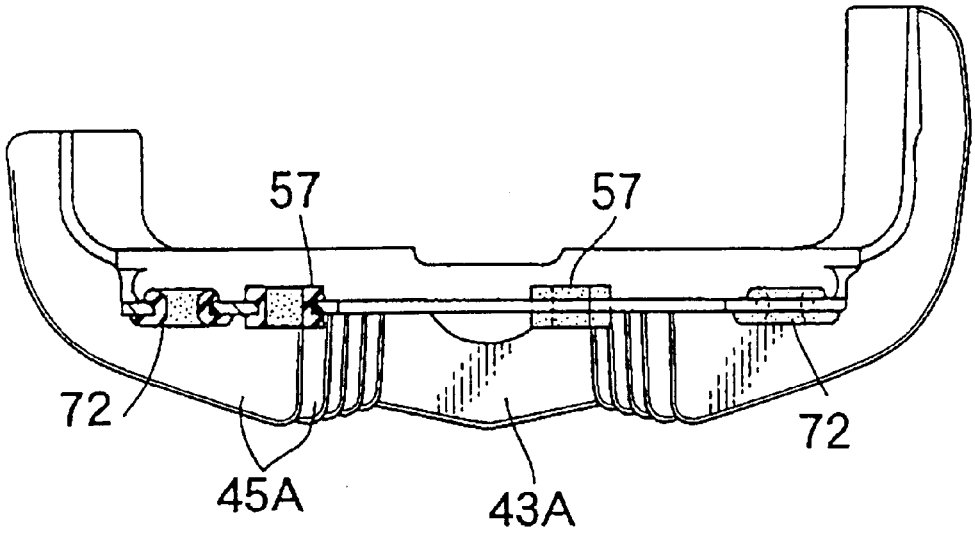
FIG. 9 is a cross-sectional view taken along line 9—9 of FIG. 8.
Figure 10:
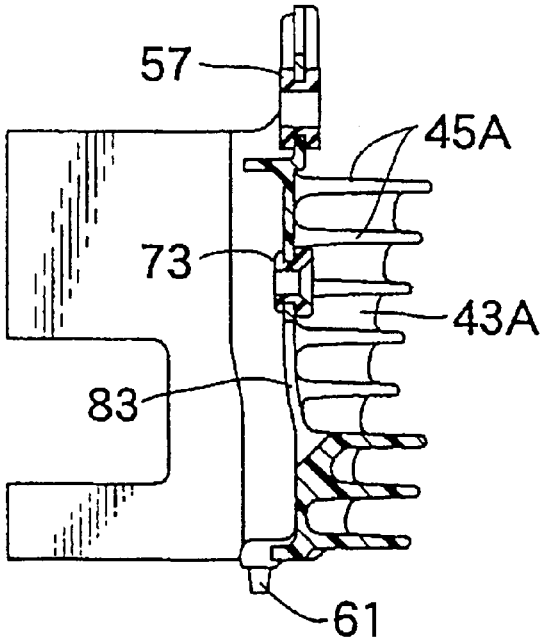
FIG. 10 is a cross-sectional view taken along line 10—10 of FIG. 8.

In FIGS. 8 to 10, in the upper portion of the left-side first dummy cover 43A, at least one cylindrical resilient member 57 (a pair of cylindrical resilient members 57, 57 in this embodiment) is provided. In the left side of the first head cover 35A as part of the engine main unit 32, bosses 58 . . . corresponding to the resilient members 57, 57 protrude outwardly. Bolts 60 . . . extending through metal sleeves 51 . . . inserted into the resilient members 57, 57 are threadedly engaged with the bosses 58 . . . . At least one spot (two spots in this embodiment) of the left-side first dummy cover 43A is fastened to the first head cover 35A as part of the engine main unit 32 with the bolts 60 . . . .

A notch 83 for arranging the other spark plug 52 of the pair of spark plugs 51, 52 facing the combustion chamber 50 is provided in the left-side first dummy cover 43A. Fins 44B . . . avoid the notch 83 and are provided in the side of the left-side first dummy cover 43A.

At least one projection 61 (a pair of projections 61, 61 in this embodiment) protrudes in the lower portion of the left-side first dummy cover 43A. In the first cylinder 33A in a portion corresponding to the fin 40A closest to the first cylinder head 34A of the fins 40A . . . in the first cylinder 33A, that is, the uppermost fin 40A, metal cylindrical members 63 . . . are buried corresponding to the projections 61 . . . . The projections 61 . . . are fitted in recesses 62 . . . provided in the first cylinder 33A so as to be constructed by the cylindrical members 63 . . . and the first cylinder 33A.

At least part of the first head cover 35A coupled to the first cylinder head 34A (the right and left sides of the first head cover 35A in this embodiment) is covered by a right-side first overhead cover 64A and a left-side first overhead cover 65A.

Figure 11:
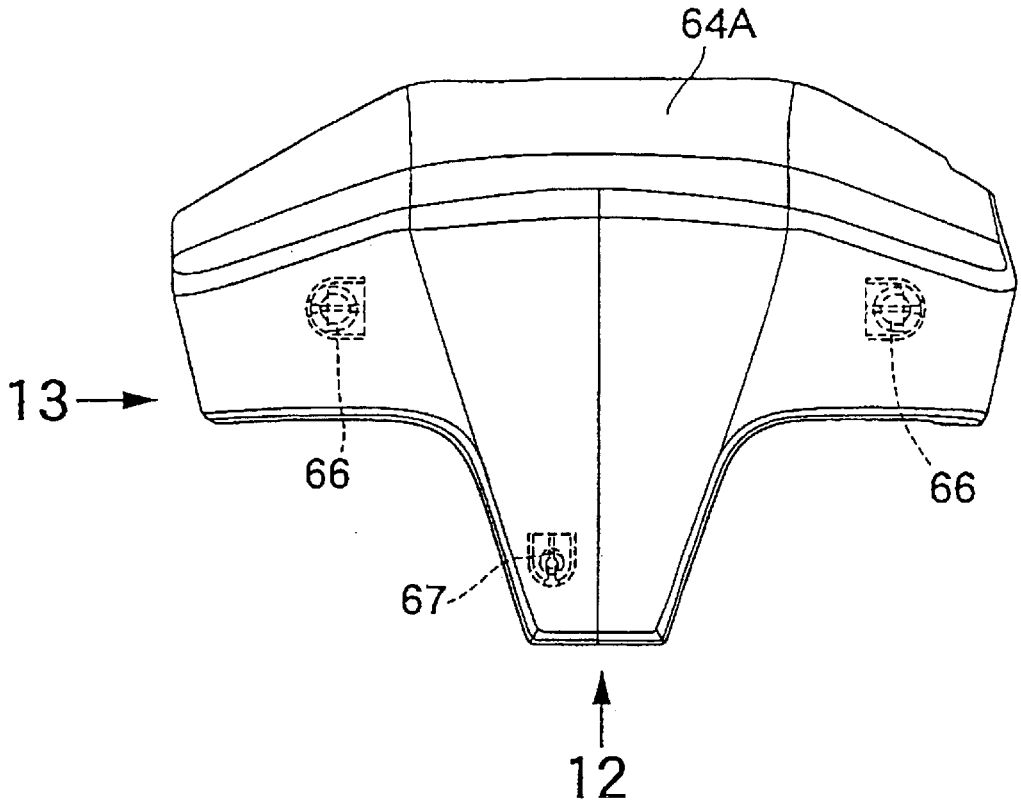
FIG. 11 is a right side view of a right-side overhead cover.
Figure 12:
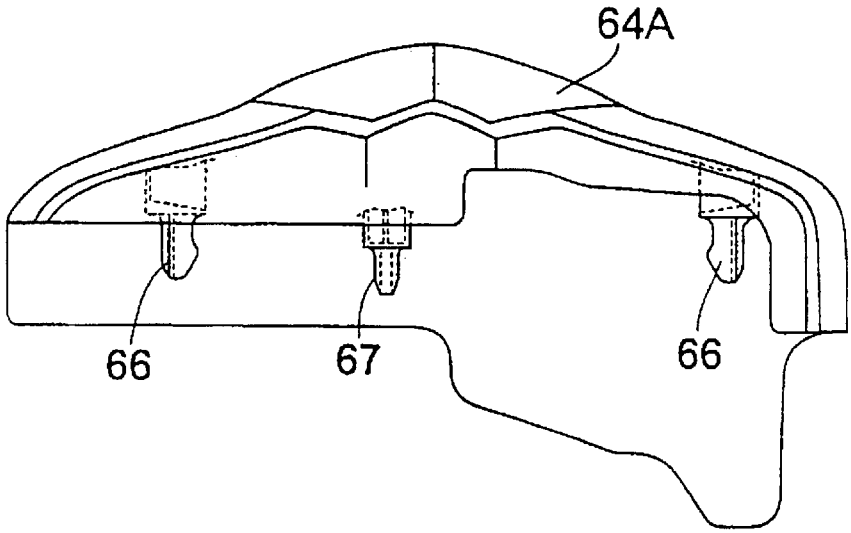
FIG. 12 is a diagram of arrow 12 of FIG. 11.
Figure 13:
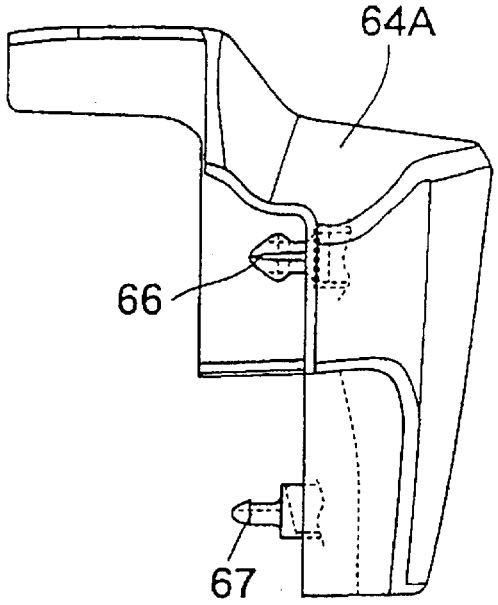
FIG. 13 is a diagram of arrow 13 of FIG. 11.

In FIGS. 11 to 13, the right-side first overhead cover 64A is formed of synthetic resin so as to cover the right side of the first head cover 35A from above and the sides and is mounted on the right-side first dummy cover 42A so as to be detachable or attachable.

The right-side first overhead cover 64A has the side view formed in a substantially T shape so as to cover the bolts 41 . . . for mounting the right-side first dummy cover 42A on the first head cover 35A and the notch 53 provided in the right-side first dummy cover 42A to arrange the spark plug 51 when mounted to the right-side first dummy cover 42A.

In the upper portion of the right-side first overhead cover 64A, a pair of engaging projections 66, 66 protrudes to the right-side first dummy cover 42A side protrude. In the lower portion of the right-side first overhead cover 64A in the middle position between the engaging projections 66, 66, an engaging projection 67 protruding to the right-side first dummy cover 42A side.

In the right-side first dummy cover 42A, cylindrical engaging members 68, 68 made of synthetic resin are provided corresponding to both the engaging projections 66, 66 and the cylindrical engaging member 61 made of synthetic resin is provided corresponding to the engaging projection 67. The engaging projections 66, 66, 67 inserted into the engaging members 68, 68, 61 are resiliently engaged with the engaging members 68, 68, 61. The right-side first overhead cover 64A is supported in the right-side first dummy cover 42A by the resilient engagement permitting detachment or attachment.

The engaging member 61 is formed cylindrically. The engaging members 68, 68 are formed in a cylindrical shape having an ellipse cross-sectional shape which extends upwardly and downwardly. The upper portion of the right-side first overhead cover 64A is in a state where the engaging projection 67 is resiliently engaged with an engaging member 69 pressed to the right-side first dummy cover 42A side. The engaging projections 66, 66 can be easily resiliently engaged with the engaging members 68, 68. The right-side first overhead cover 64A can be easily mounted on the right-side first dummy cover 42A.

Figure 14:
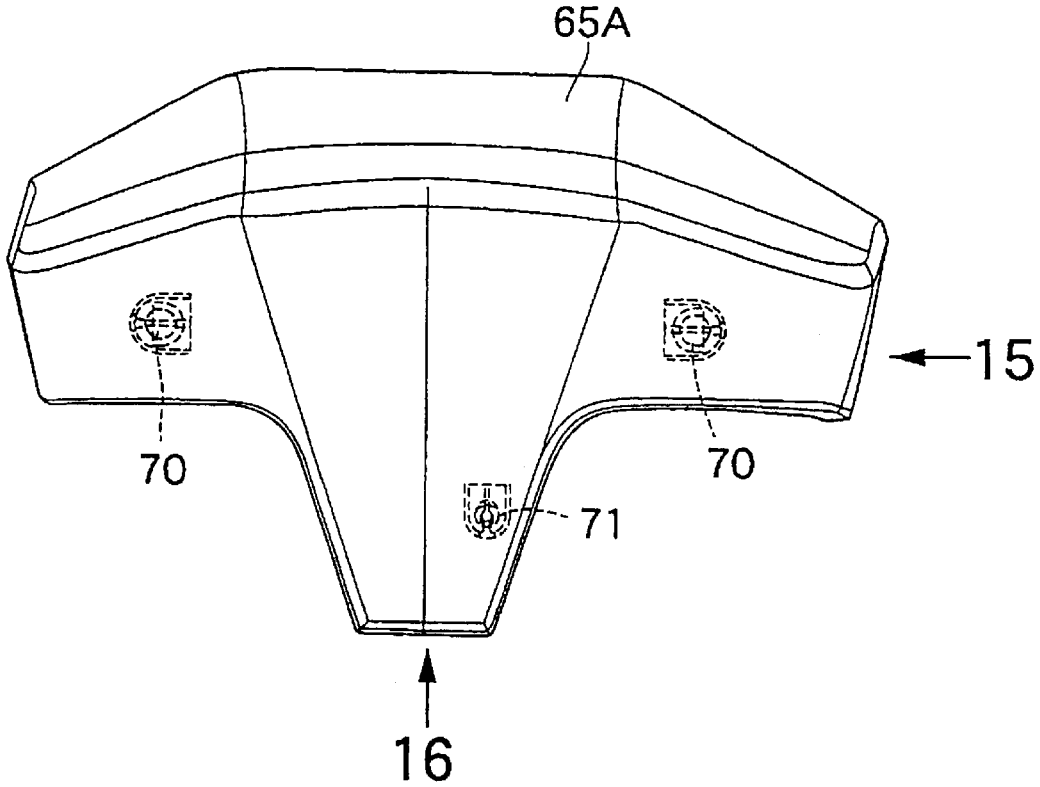
FIG. 14 is a left side view of a left-side overhead cover.
Figure 15:
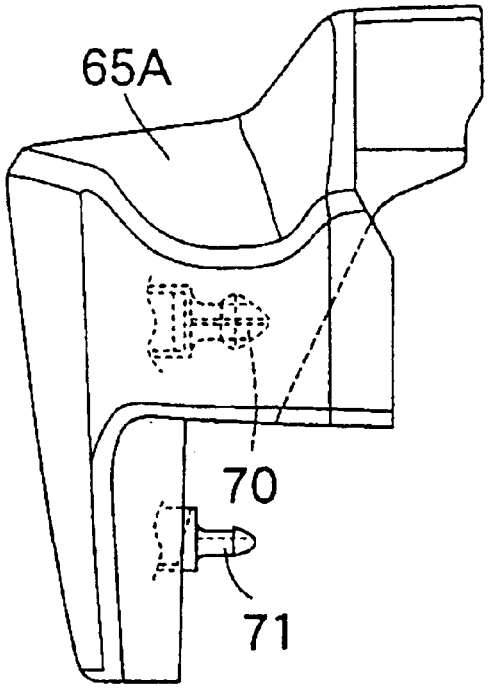
FIG. 15 is a diagram of arrow 15 of FIG. 14.
Figure 16:
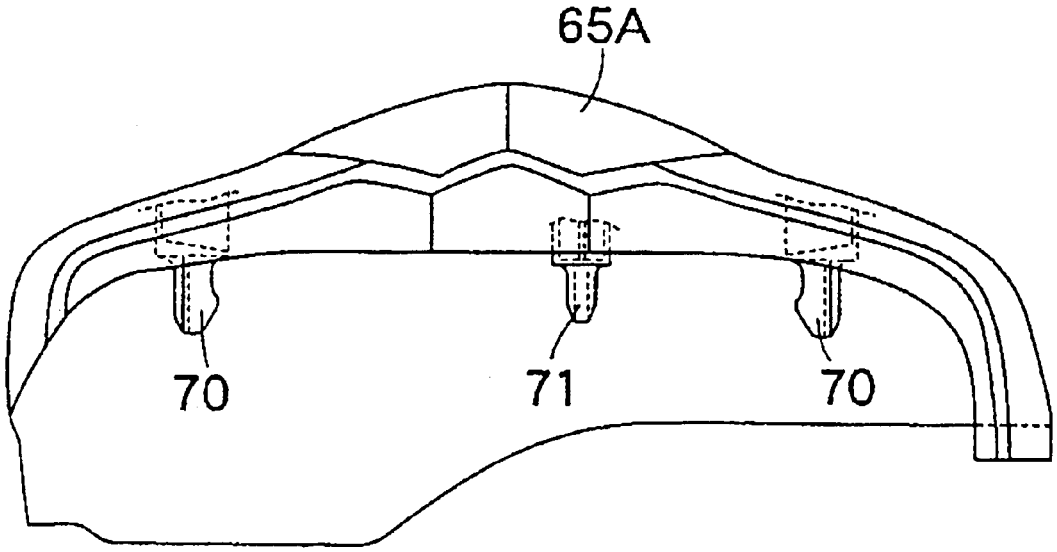
FIG. 16 is a diagram of arrow 16 of FIG. 14.

In FIGS. 14 to 16, the left-side first overhead cover 65A is formed of synthetic resin so as to cover the left side of the first head cover 35A from above and the sides and are mounted on the left-side first dummy cover 43A so as to be detachable or attachable.

The left-side first overhead cover 65A has the side view formed of a substantially T shape as in the right-side first overhead cover 64A so as to cover the bolts 60 . . . for mounting the left-side first dummy cover 43A on the first head cover 35A and the notch 83 provided in the left-side first dummy cover 43A to arrange the spark plug 52 when mounted to the left-side first dummy cover 43A.

In the upper portion of the left-side first overhead cover 65A, a pair of engaging projections 70, 70 project to the left-side first dummy cover 43A side. In the lower portion of the left-side first overhead cover 65A in the middle position between the engaging projections 70, 70, an engaging projection 71 protrudes to the left-side first dummy cover 43A side.

In the left-side first dummy cover 43A, cylindrical engaging members 72, 72 made of synthetic resin are provided corresponding to both the engaging projections 70, 70 and a cylindrical engaging member 73 made of synthetic resin corresponds to the engaging projection 71. The engaging projections 70, 70, 71 inserted into the engaging members 72, 72, 73 are resiliently engaged with the engaging members 72, 72, 73. The left-side first overhead cover 65A is supported in the left-side first dummy cover 43A by the resilient engagement permitting detachment or attachment.

The engaging member 73 is formed cylindrically. The engaging members 72, 72 are formed in a cylindrical shape having an ellipse cross-sectional shape which extends upwardly and downwardly. The upper portion of the left-side first overhead cover 65A is in a state where the engaging projection 71 is resiliently engaged with the engaging member 73 pressed to the left-side first dummy cover 43A side. The engaging projections 70, 70 can be easily resiliently engaged with the engaging members 72, 72. The left-side first overhead cover 65A can be easily mounted on the left-side first dummy cover 43A.

Again in FIGS. 2 and 3, the right side of the second cylinder head 34B of the second bank BB is covered by a right-side second dummy cover 42B. The left side of the second cylinder head 34B is covered by a left-side second dummy cover 43B thereof. The dummy covers 42B, 43B are intended for enhancing the functional beauty of the engine E and are made of metal to eliminate heat and to enhance the functional beauty. An equal plurality of fins 44B . . . , 45B . . . as dummy cooling fins are provided on the sides of the dummy covers 42B, 43B, respectively.

At least one spot (two spots in this embodiment) of the dummy covers 42B, 43B is fastened to the second head cover 35B as part of the engine main unit 32 as in the dummy covers 42A, 43A of the first bank BA. The lower portions of the dummy covers 42B, 43B are fittedly supported in the upper portion of the second cylinder 33B, as in the dummy covers 42A, 43A of the first bank BA. The right-side and left-side second dummy covers 42B, 43B are provided with the notches for arranging the spark plugs mounted on the second cylinder head 34B, as in the right-side and left-side first dummy covers 42A, 43A.

At least part of the second head cover 35B coupled to the second cylinder head 34B is covered by a right-side second overhead cover 64B and a left-side second overhead cover 65B.

The right-side second overhead cover 64B is formed of synthetic resin so as to cover the right side of the second head cover 35B from above and the sides and is mounted on the right-side second dummy cover 42B so as to be detachable or attachable, as in the right-side first overhead cover 64A on the first bank BA side. The left-side second overhead cover 65B is formed of synthetic resin so as to cover the left side of the second head cover 35B from above and the sides and is mounted on the left-side second dummy cover 43B so as to be detachable or attachable, as in a left-side second overhead cover 64B on the first bank BA side.

The right-side and left-side second overhead covers 64B, 65B have the side view formed in a substantially T shape so as to cover the fastening portion of the right-side and left-side second dummy covers 42B, 43B to the second head cover 35B. The right-side and left-side second overhead covers 64B, 65B cover the notches of the right-side and left-side second dummy covers 42B, 43B.

To reduce the nip angle of the first and second banks BA, BB, in a plane orthogonal to the axis of the crankshaft 30, a cross point CP of the cylinder axes CA, CB of both the banks BA, BB is arranged in a position offset, for example, forward from the axis of the crankshaft 30. In the plane, a length LA1 between a deck surface 75A of the first cylinder head 34A of the first bank BA and the cross point CP and a length LB1 between a deck surface 75B of the second cylinder head 34B of the second bank BB and the cross point CP are different from each other so that LA1<LB1.

The lengths LA1 and LB1 are different so that a difference in height between both the banks BA, BB is significant visually. A feeling of unbalance may be produced, resulting in a deterioration of the functional beauty of the engine E.

Figure 17:
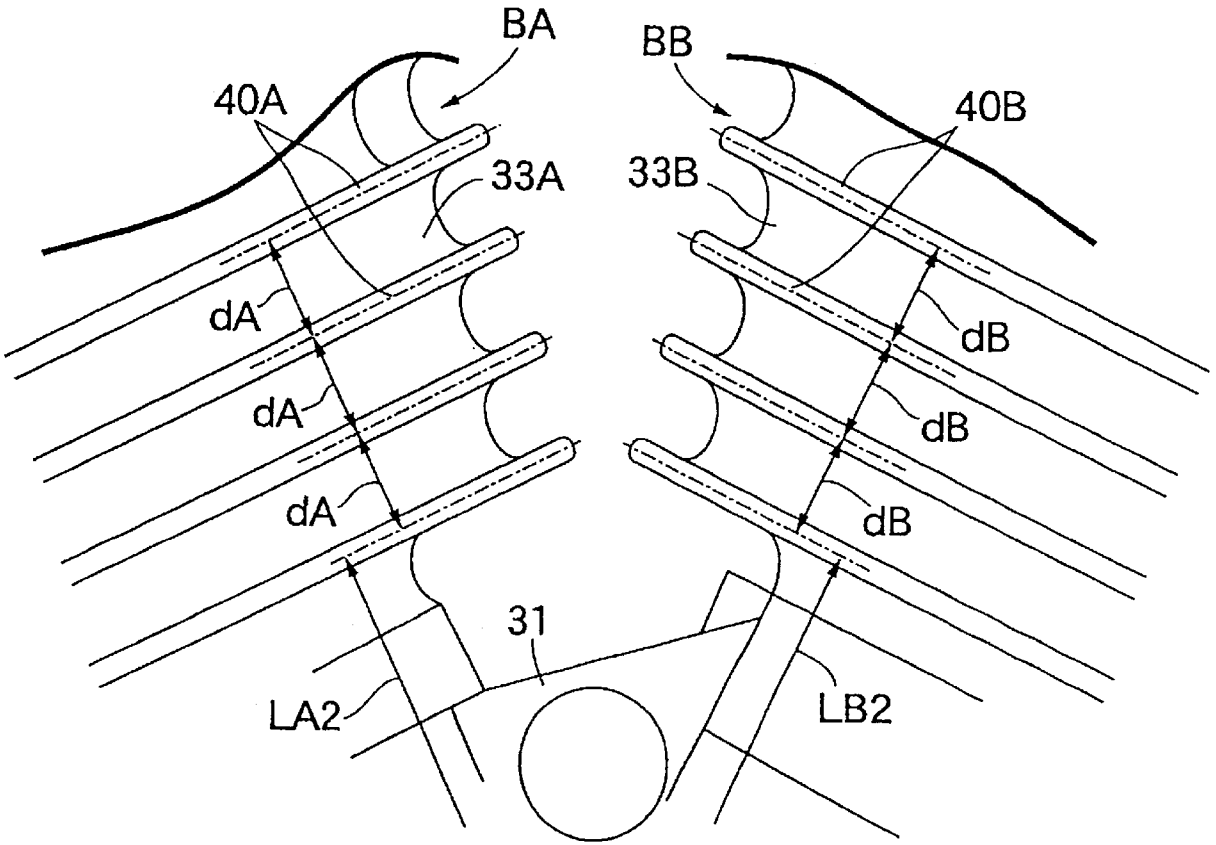
FIG. 17 is an enlarged side view of portions on a crankcase side of a first and a second cylinders viewed from the left side of the motorcycle.

The total numbers of a plurality of the fins 40A . . . , 44A . . . , 45A . . . , 40B . . . , 44B . . . , 45B . . . provided in the sides of the cylinders 33A, 33B of the first and second banks BA, BB and the sides of the dummy covers 42A, 43A; 42B, 43B for covering the head covers 34A, 34B coupled to the cylinders 33A, 33B from both the right and left sides and aligned in the direction along the cylinder axes CA, CB of both the banks BA, BB are set to be equal in the first and second banks BA, BB. A center line mutual distance dA of the fins 40A . . . , 44A . . . , 45A . . . on the first bank BA side and a center line mutual distance dB of the fins 40B . . . , 44B . . . , 45B . . . on the second bank BB side are set to be almost equal, as shown in FIG. 17.

The lengths LA2, LB2 between the center lines of the fins 40A, 40B closest to the crankshaft 30 of the fins 40A . . . , 44A . . . , 45A . . . , 40B . . . , 44B . . . , 45B . . . and the cross point CP in the plane orthogonal to the axis of the crankshaft 30 are set to be almost equal in the first and second banks BA, BB.

In the side view in the direction along the axis of the crankshaft 30, the contour shapes of the first and second cylinders 33A, 33B including the fins 40A 40B . . . and the dummy covers 42A, 43A; 42B, 43B including the fins 44A, 45A; 44B, 45B are formed almost symmetrically with respect to a plane including a bisector 76 between both the banks BA, BB passing through the cross point CP in the plane orthogonal to the axis of the crankshaft 30.

A length LA3 between cross points at which the right-side and left-side first overhead covers 64A, 65A cross the cylinder axis CA of the first cylinder 33A in a plane orthogonal to the axis of the crankshaft 30 and the cross point CP at which the cylinder axes CA, CB cross each other in the plane and a length LB3 between a cross point at which the right-side and left-side second overhead covers 64B, 65B cross the cylinder axis CB of the second cylinder 33B in a plane orthogonal to the axis of the crankshaft 30 and the cross point CP at which the cylinder axes CA, CB cross each other in the plane are set to be almost equal.

The front portion of the fist cylinder head 34A of the first bank BA is connected to the upstream end of an exhaust pipe 77A extended rearwardly on the right side of the body frame 21. The rear portion of the second cylinder head 34B of the second bank BB is connected to the upstream end of an exhaust pipe 77B formed to be bent on the right side of the body frame 21. Exhaust mufflers 78A, 78B arranged on the right side of the rear wheel WR are connected to the downstream ends of the exhaust pipes 77A, 77B. High tension cords 79, 80 . . . continuous to the pair of spark plugs 51, 52 . . . mounted on each of the cylinder heads 34A, 34B of both the banks BA, BB are drawn upwardly from between the right-side and left-side first overhead covers 64A, 65A and the right-side and left-side second overhead covers 64B, 65B.

The operation of this embodiment will be described. In the sides of the cylinders 33A, 33B of the first and second banks BA, BB and the sides of the dummy covers 42A, 43A; 42B, 43B for covering the head covers 34A, 34B from both the right and left sides, the plurality of fins 40A . . . , 44A . . . , 45A . . . ; 40B . . . , 44B . . . , 45B . . . aligned in the direction along the cylinder axes CA, CB of the first and second cylinders 33A, 33B are provided so that the total numbers of the fins 40A . . . , 44A . . . , 45A . . . ; 40B . . . , 44B . . . , 45B . . . and the center line mutual distances dA and dB of the fins 40A . . . , 44A . . . , 45A . . . ; 40B . . . , 44B . . . , 45B . . . are almost equal in the first and second banks BA, BB. The lengths LA2, LB2 between the center lines of the fins 40A, 40B closest to the crankshaft 30 of the fins 40A . . . , 44A . . . , 45A . . . ; 40B . . . , 44B . . . , 45B . . . and the cross point CP in the plane orthogonal to the axis of the crankshaft 30 are set to be almost equal in the first and second banks BA, BB.

The fins 40A . . . , 44A . . . , 45A . . . ; 40B . . . , 44B . . . , 45B . . . for enhancing the appearance have a function to decide the appearance shape of both the banks BA, BB. In the above-described construction, the fins 40A . . . , 44A . . . , 45A . . . ; 40B . . . , 44B . . . , 45B . . . in both the banks BA, BB are arranged corresponding to almost the same position along the cylinder axes CA, CB of the banks BA, BB. A visual impression so that the heights of both the banks BA, BB are not different can be obtained. The functional beauty of the V-type engine E can be enhanced and the marketability of the engine E can be improved.

In the side view in the direction along the axis of the crankshaft 30, the contour shapes of the first and second cylinders 33A, 33B including the fins 40A . . . , 40B . . . and the dummy covers 42A, 43A; 42B, 43B including the fins 44A, 45A; 44B, 45B are formed almost symmetrically with respect to a plane including the bisector 76 between both the banks BA, BB passing through the cross point CP of the cylinder axes CA, CB of both the banks BA, BB. The contours of the first and second banks BA, BB are shaped almost symmetrically. The functional beauty of the V-type engine E can be enhanced and the marketability can be improved.

The lengths LA3, LB3 between cross points at which the right-side and left-side first overhead covers 64A, 65A and the right-side and left-side second overhead covers 64B, 65B for covering at least part of the first and second head covers 35A, 35B or the right and left sides of the first and second head covers 35A, 35B in this embodiment from above and the sides cross the cylinder axes CA, CB of the first and second cylinders 33A, 33B in a plane orthogonal to the axis of the crankshaft 30 and the cross point CP at which both the cylinder axes CA, CB cross each other in the plane are set to be almost equal in both the banks BA, BB. The height difference and the appearance shape difference of both the banks BA, BB appear to be small. The functional beauty of the V-type engine E can be enhanced and the marketability can be improved.

In the banks BA, BB, to the head covers 35A, 35B as part of the engine main unit 32, the right-side and left-side first dummy covers 42A, 43A and the right-side and left-side second dummy covers 42B, 43B for covering the cylinder heads 34A, 34B from the right and left sides are fastened in at least one spot thereof or two spots thereof in this embodiment.

The dummy covers 42A, 43A; 42B, 43B are provided with the fins 44A, 45A; 44B, 45B are formed of metal to eliminate heat and to enhance the functional beauty. Strong support is thus required. As described above, at least one spot of the dummy covers 42A, 43A; 42B, 43B is fastened to the engine main unit 32. The dummy covers 42A, 43A; 42B, 43B can be supported strongly in the engine main unit 32.

In many cases, the overhead covers 64A, 65A; 64B, 65B require no fins and are formed of synthetic resin as light-weight material since requirements to eliminate heat and to enhance the functional beauty are relatively low. The overhead covers 64A, 65A; 64B, 65B need not be supported very strongly.

The plurality of engaging projections 66 . . . , 67; 70 . . . , 71 provided in the overhead covers 64A, 65A; 64B, 65B are resiliently engaged with the dummy covers 42A, 43A; 42B, 43B so as to be detachable or attachable. The dummy covers 42A, 43A; 42B, 43B and the overhead covers 64A, 65A; 64B, 65B can be supported in the engine main unit 32 in a construction suitable thereto.

The bolts 49, 60 . . . for fastening at least one spot of the dummy covers 42A, 43A; 42B, 43B to the engine main unit 32 are covered by the overhead covers 64A, 65A; 64B, 65B constructing the parts of a special shape with a surface treatment which has been required since the bolts 49, 60 . . . are exposed to outside is unnecessary. The cost can be reduced and the functional beauty of the engine E can be enhanced.

The right-side first and second dummy covers 42A, 42B and the left-side first and second dummy covers 43A, 43B are provided with the notches 53 . . . , 83 . . . for arranging the spark plugs 51 . . . , 52 . . . mounted on the cylinder heads 34A, 34B. The right-side first and second overhead covers 64A, 65A and the left-side first and second overhead covers 64B, 65B are formed in a shape to cover the notches 53 . . . , 83 . . . from above. The notches 53 . . . , 83 . . . for arranging the spark plugs 51 . . . , 52 . . . are covered by the overhead covers 64A, 65A, 64B, 65B from above. The functional beauty can be enhanced.

The plurality of engaging projections 66, 66, 67 . . . , 70, 70, 71 . . . provided in the overhead covers 64A, 64B, 65A, 65B are resiliently engaged with the dummy covers 42A, 42B, 43A, 43B so as to be detachable or attachable. The overhead covers 64A, 65B, 65A, 65B can be easily detached or attached. The maintenance operability of the spark plugs 51 . . . , 52 . . . can be improved.

In portions corresponding to the fins 40A, 40B closest to the cylinder heads 34A, 34B of the plurality of fins 40A . . . , 40B . . . , provided in the sides of the cylinders 33A, 33B aligned in the direction along the cylinder axes CA, CB, at least one (two in this embodiment) of the recesses 55 . . . , 62 . . . is provided in the cylinders 33A, 33B. The projections 54 . . . , 61 . . . provided in the dummy covers 42A, 43A; 42B, 43B are fitted in the recesses 55 . . . , 62 . . . .

The dummy covers 42A, 43A; 42B, 43B are supported by the cylinders 33A, 33B of the engine main unit 32 together with a fastening of at least one spot thereof to the engine main unit 32 with the bolts 49, 60. The dummy covers 42A, 43A; 42B, 43B which become relatively very heavy can be fixed reliably to the engine main unit 32. The mutual fitting portions of the dummy covers 42A, 43A; 42B, 43B and the cylinders 33A, 33B can be hidden by the fins 40A, 40B provided in the cylinders 33A, 33B. The mutual fitting of the dummy covers 42A, 43A; 42B, 43B and the cylinders 33A, 33B will not deteriorate the functional beauty of the engine E.

The embodiment of the present invention are described above. The present invention is not limited to the embodiment and can make various design modifications without deviating from the present invention described in claims.

The present invention can be applied to a V-type engine for a motorcycle in which at least part of the first and second cylinders 33A, 33B is covered from the sides by the dummy covers having a plurality of fins projecting from sides thereof, a V-type engine for a motorcycle in which a plurality of fins are provided projecting from the sides of the first and second cylinder heads 34A, 34B, and a V-type engine for a motorcycle wherein the overhead covers for covering at least part of the head covers from above and the sides are not mounted.

As described above, in the present invention the heights of a pair of banks are visually recognized to be almost equal. The functional beauty of the engine can be enhanced and the marketability can be improved.

In the present invention, the first and second cylinders are shaped almost symmetrically. The functional beauty of the V-type engine can be enhanced and the marketability can be improved.

In the present invention, the height difference and the appearance shape difference between both the banks appear to be smaller. The functional beauty of the V-type engine can be enhanced and the marketability can be improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A V-type engine for a motorcycle having a first bank with a first cylinder coupled to a first cylinder head and a second bank having a second cylinder coupled to a second cylinder head being arranged in a V-shape in a plane orthogonal to the axis of a crankshaft with a length between a cross point at which cylinder axes of the first and second cylinders cross each other in said plane and a deck surface of the first cylinder head and a length between said cross point and a deck surface of the second cylinder head being set to be different relative to each other comprising:

a plurality of fins aligned in the direction along the cylinder axes of the first and second cylinders are provided on sides of the first and second cylinders or sides of dummy covers for covering at least part of the first and second cylinders from the sides and sides of the first and second cylinder heads or sides of the dummy covers for covering at least part of the first and second cylinder heads from the sides;

wherein the total numbers of the fins and center line mutual distances of the fins are almost equal in the first and second banks, and lengths in said plane between the center lines of the fins closest to the crankshaft of said fins and said cross point are set to be almost equal in the first and second banks.

2. The V-type engine for a motorcycle according to claim 1, wherein contour shapes including said fins of the first and second cylinders or the dummy covers for covering at least part of the first and second cylinders from the sides and the first and second cylinder heads or the dummy covers for covering at least part of the first and second cylinder heads from the sides are formed almost symmetrically with respect to a plane including a bisector between both the banks passing though said cross point in the side view in the direction along the axis of said crankshaft.

3. The V-type engine for a motorcycle according to claim 2, wherein lengths between cross points at which first and second head covers coupled to the first and second cylinder heads or first and second overhead covers for covering at least part of the first and second head covers from above and the sides cross the cylinder axes of the first and second cylinders in said plane and the cross point at which the cylinder axes of the first and second cylinders cross each other in said plane are set to be almost equal in the first and second banks.

4. The V-type engine for a motorcycle according to claim 1, wherein lengths between cross points at which first and second head covers coupled to the first and second cylinder heads or first and second overhead covers for covering at least part of the first and second head covers from above and the sides cross the cylinder axes of the first and second cylinders in said plane and the cross point at which the cylinder axes of the first and second cylinders cross each other in said plane are set to be almost equal in the first and second banks.

5. The V-type engine for a motorcycle according to claim 1, wherein the dummy cover for covering the first and second cylinders includes a resilient member for mating with bosses formed in the first and second cylinders for securing the dummy cover relative thereto.

6. The V-type engine for a motorcycle according to claim 5, and further including projections formed on said dummy cover for engaging with recesses formed in said first and second cylinders for mounting the dummy cover relative thereto.

7. The V-type engine for a motorcycle according to claim 5, wherein said dummy covers for covering at least part of the first and second cylinder heads include projections for mounting relative to said dummy cover for covering the first and second cylinders.

8. The V-type engine for a motorcycle according to claim 7, and further including engaging members formed in dummy cover for covering the first and second cylinders for engaging with the projections formed on said dummy covers for covering at least part of the first and second cylinder heads.

9. The V-type engine for a motorcycle according to claim 8, wherein said engaging members formed in dummy cover for covering the first and second cylinders for engaging with the projections formed on said dummy covers for covering at least part of the first and second cylinder heads include a resilient surface for engaging and securely mounting the projections formed on said dummy covers for covering at least part of the first and second cylinder heads.

10. The V-type engine for a motorcycle according to claim 1, wherein said dummy covers for covering at least part of the first and second cylinder heads are formed in the shape of a T.

11. A V-type engine for a motorcycle having a first bank with a first cylinder coupled to a first cylinder head and a second bank having a second cylinder coupled to a second cylinder head being arranged in a V-shape in a plane orthogonal to the axis of a crankshaft wherein a head surface of said first and second cylinders is not on the same plane relative to each other comprising:

at least one dummy cover for covering at least part of the first or second cylinders from the side for enabling an alignment of said the head surface of said first and second cylinders to be on substantially the same horizontal plane relative to each other by covering and extending at least part of the first or second cylinder heads from the sides.

12. The V-type engine for a motorcycle according to claim 11, wherein a contour shape of said dummy cover includes fins for corresponding to fins of the first and second cylinders.

13. The V-type engine for a motorcycle according to claim 12, and further including at least one head cover for covering at least part of the head surface of said first or second cylinders, wherein a length between cross points at which said at least one head cover coupled to the first or second cylinder heads and a cylinder head of said second or first cylinder is set to be almost equal in the first and second banks.

14. The V-type engine for a motorcycle according to claim 11, and further including at least one head cover for covering at least part of the head surface of said first or second cylinders, wherein a length between cross points at which said at least one head cover coupled to the first or second cylinder heads and a cylinder head of said second or first cylinder is set to be almost equal in the first and second banks.

15. The V-type engine for a motorcycle according to claim 11, wherein the at least one dummy cover for covering the first or second cylinders includes a resilient member for mating with bosses formed in the first and second cylinders for securing the at least one dummy cover relative thereto.

16. The V-type engine for a motorcycle according to claim 15, and further including projections formed on said at least one dummy cover for engaging with recesses formed in said first or second cylinders for mounting the at least one dummy cover relative thereto.

17. The V-type engine for a motorcycle according to claim 15, wherein said at least one dummy covers for covering at least part of the first or second cylinder heads include projections for mounting relative to said at least one dummy cover for covering the first and second cylinders.

18. The V-type engine for a motorcycle according to claim 17, and further including engaging members formed in the at least one dummy cover for covering the first and second cylinders for engaging with projections formed on a dummy cover for covering at least part of the head surface of said first or second cylinders.

19. The V-type engine for a motorcycle according to claim 18, wherein said at least one dummy cover for covering at least part of the head surface of said first or second cylinders is formed in the shape of a T.

20. The V-type engine for a motorcycle according to claim 18, wherein said engaging members formed in at least one dummy cover for covering the first or second cylinders for engaging with the projections formed on said at least one dummy cover for covering at least part of the head surface of said first or second cylinders include a resilient surface for engaging and securely mounting the projections formed on said at least one dummy cover for covering at least part of the head surface of said first or second cylinders.

* * * * *